US008373599B2

(12) United States Patent
Lin et al.

(10) Patent No.: US 8,373,599 B2
(45) Date of Patent: Feb. 12, 2013

(54) ANTENNA MODULE, WIRELESS COMMUNICATION DEVICE USING THE ANTENNA MODULE AND METHOD FOR ADJUSTING A PERFORMANCE FACTOR OF THE ANTENNA MODULE

(75) Inventors: Shih-Chieh Lin, Taoyuan (TW); Chin-Hung Ma, Taoyuan (TW)

(73) Assignee: FIH (Hong Kong) Limited, Kowloon (HK)

( * ) Notice: Subject to any disclaimer, the term of this patent is extended or adjusted under 35 U.S.C. 154(b) by 408 days.

(21) Appl. No.: 12/788,436

(22) Filed: May 27, 2010

(65) Prior Publication Data

US 2011/0156964 A1 Jun. 30, 2011

(30) Foreign Application Priority Data

Dec. 30, 2009 (TW) ..... 98146032 A

(51) Int. Cl.
*H01Q 5/00* (2006.01)

(52) U.S. Cl. ..... 343/700 MS; 343/702

(58) Field of Classification Search ..... 343/700 MS, 343/702, 893
See application file for complete search history.

(56) References Cited

U.S. PATENT DOCUMENTS

| | | | | |
|---|---|---|---|---|
| 6,567,048 | B2 * | 5/2003 | McKinzie et al. | 343/700 MS |
| 6,724,345 | B2 * | 4/2004 | Tran | 343/700 MS |
| 2003/0020655 | A1 * | 1/2003 | McKinzie et al. | 343/700 MS |
| 2003/0197646 | A1 * | 10/2003 | Tran | 343/700 MS |
| 2004/0027291 | A1 * | 2/2004 | Zhang et al. | 343/700 MS |
| 2006/0092079 | A1 * | 5/2006 | de Rochemont | 343/700 MS |
| 2012/0154234 | A1 * | 6/2012 | Geiler et al. | 343/787 |

* cited by examiner

*Primary Examiner* — Don Le
(74) *Attorney, Agent, or Firm* — Altis Law Group, Inc.

(57) ABSTRACT

An antenna module includes an antenna, a substrate defining a plurality of notches, and a plurality of filling blocks. The antenna is attached to the substrate. The filling blocks have a permittivity higher than the substrate and are received in a portion of the notches covered by the antenna to raise the permittivity of the substrate.

19 Claims, 8 Drawing Sheets

ANTENNA MODULE, WIRELESS COMMUNICATION DEVICE USING THE ANTENNA MODULE AND METHOD FOR ADJUSTING A PERFORMANCE FACTOR OF THE ANTENNA MODULE

BACKGROUND

1. Technical Field

The disclosure generally relates to antenna modules, particularly to an antenna module having adjustable working frequencies and a wireless communication device using the same.

2. Description of Related Art

Antennas are usually assembled in a portable wireless communication device to send and/or receive signals. Commonly, frequencies of the antennas are adjusted according to different communication requirements by matching circuits disposed on a circuit board of the portable wireless communication device. However, the matching circuits make structures of the circuit board more complex.

Therefore, there is room for improvement within the art.

BRIEF DESCRIPTION OF THE DRAWINGS

Many aspects of the antenna module, wireless communication device using the antenna module and method for adjusting a performance factor of an antenna module can be better understood with reference to the following drawings. The components in the drawings are not necessarily drawn to scale, the emphasis instead being placed upon clearly illustrating the principles of the antenna module, wireless communication device using the antenna module and method for adjusting a performance factor of an antenna module.

DETAILED DESCRIPTION

Figure 1:
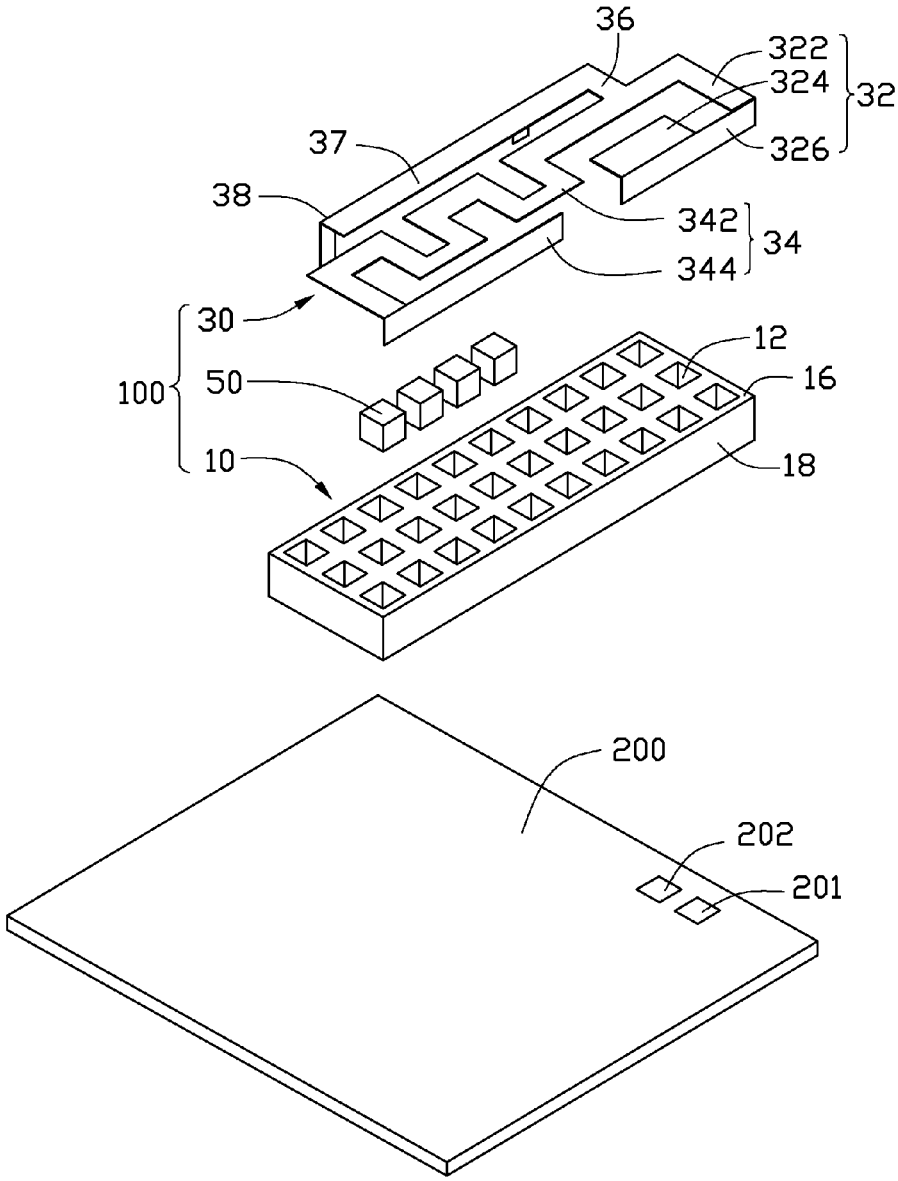
FIG. 1 shows an exploded, schematic view of a wireless communication device employed with an antenna module, according to an exemplary embodiment.

Referring to FIG. 1, an antenna module 100 mounted in a base board 200 of a wireless communication device (not shown), such as a mobile phone and a personal digital assistant (PDA), to receive and/or send signals, according to an exemplary embodiment. The base board 200 may be a circuit board. A feeding point 201 and a grounding point 202 are disposed on the base board 200.

The antenna module 100 includes a substrate 10, an antenna 30, and a plurality of filling blocks 50. The substrate 10 is generally cubic and includes a mounting surface 16 and a side surface 18. The substrate 10 is made of plastic and has a permittivity of about 2.5. The mounting surface 16 of the substrate 10 defines a plurality of notches 12 arranging in an N×M matrix array. In this embodiment, the N×M matrix is a 3×10 matrix. Each notch 12 is generally cubic and has a dimension of about 3×3×3 mm.

The antenna 30 is a dual-band antenna including a first radiating unit 32, a second radiating unit 34, a feeding portion 36, a matching portion 37 and a grounding portion 38. The first radiating unit 32 is for receiving and/or sending high frequency band signals. The first radiating unit 32 includes a first shielding portion 322, a second shielding portion 324, and a bent portion 326. The first shielding portion 322 is a substantially L-shaped sheet. The second shielding portion 324 is a substantially rectangular sheet. The second shielding portion 324 is disposed at one side of the first shielding portion 322, and coplanar with and partially surrounded by the first shielding portion 322. The bent portion 326 is a substantially strip-shaped sheet connecting perpendicular to the first shielding portion 322 and the second shielding portion 324.

The second radiating unit 34 is for receiving and/or sending low frequency band signals. The second radiating unit 34 includes a third shielding portion 342 and a second bent portion 344. The third shielding portion 342 is a square-wave shaped sheet. One end of the third shielding portion 342 extends from a distal end of the first shielding portion 322. Another end of the third shielding portion 342 connects substantially perpendicular to the second bent portion 344. The second bent portion 344 is a substantially strip-shaped sheet, and similar to the first bent portion 324. The second bent portion 344 is coplanar with and spaced from the first bent portion 324.

The feeding portion 36 is a substantially rectangular sheet extending substantially perpendicular from one side of the first shielding portion 322 of the first radiating unit 32, and opposite to the second shielding portion 324. The matching portion 37 is a substantially strip-shaped sheet connecting substantially perpendicular to the feeding portion 36 and disposed at one side of the first shielding portion 322 and the third shielding portion 342. The grounding portion 38 connects substantially perpendicular to the matching portion 37 and substantially parallel to the first bent portion 326 and the second portion 344. The structure of the antenna 30 is not limited to this embodiment, and can be changed for different communication requirements.

The filling blocks 50 may be made of material having a higher permittivity than the substrate 10, such as rubber or ceramics. Each filling block 50 is generally cubic and can be received in the notch 12 to raise the permittivity of the substrate 10 and adjust a frequency of the antenna 30. In this embodiment, the filling block 50 is made of rubber and has a permittivity about 4.

Figure 2:
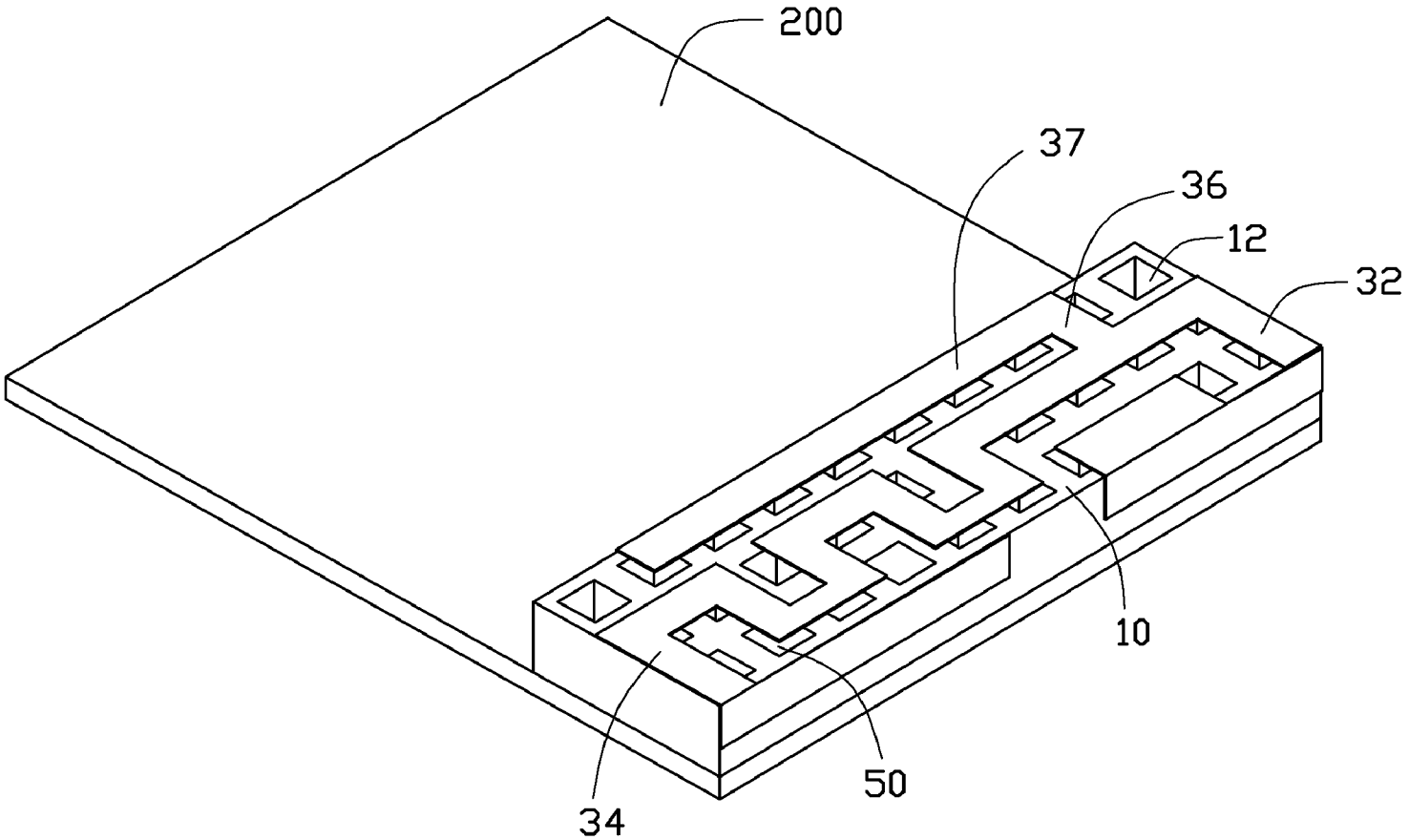
FIG. 2 shows an assembled schematic view of the wireless communication device of FIG. 1.

Referring to FIG. 2, to assemble the wireless communication device employed with the antenna module 100, the substrate 10 is secured on the base board 200. The filling blocks 50 are received in portion of the notches 12. The antenna 30 is mounted on the substrate 10, wherein the first shielding portion 322, the second shielding portion 324, the third shielding portion 342, the feeding portion 36 and the matching portion 37 are flatly attached on the mounting surface 16 of the substrate 10, the first bent portion 326 and the second bent portion 344 are flatly attached on the side surface 18 of the substrate 10. In addition, the feeding portion 36 and the grounding portion 38 are respectively connected to the feeding point 201 and the grounding point 202 of the base board 200.

Figure 3:
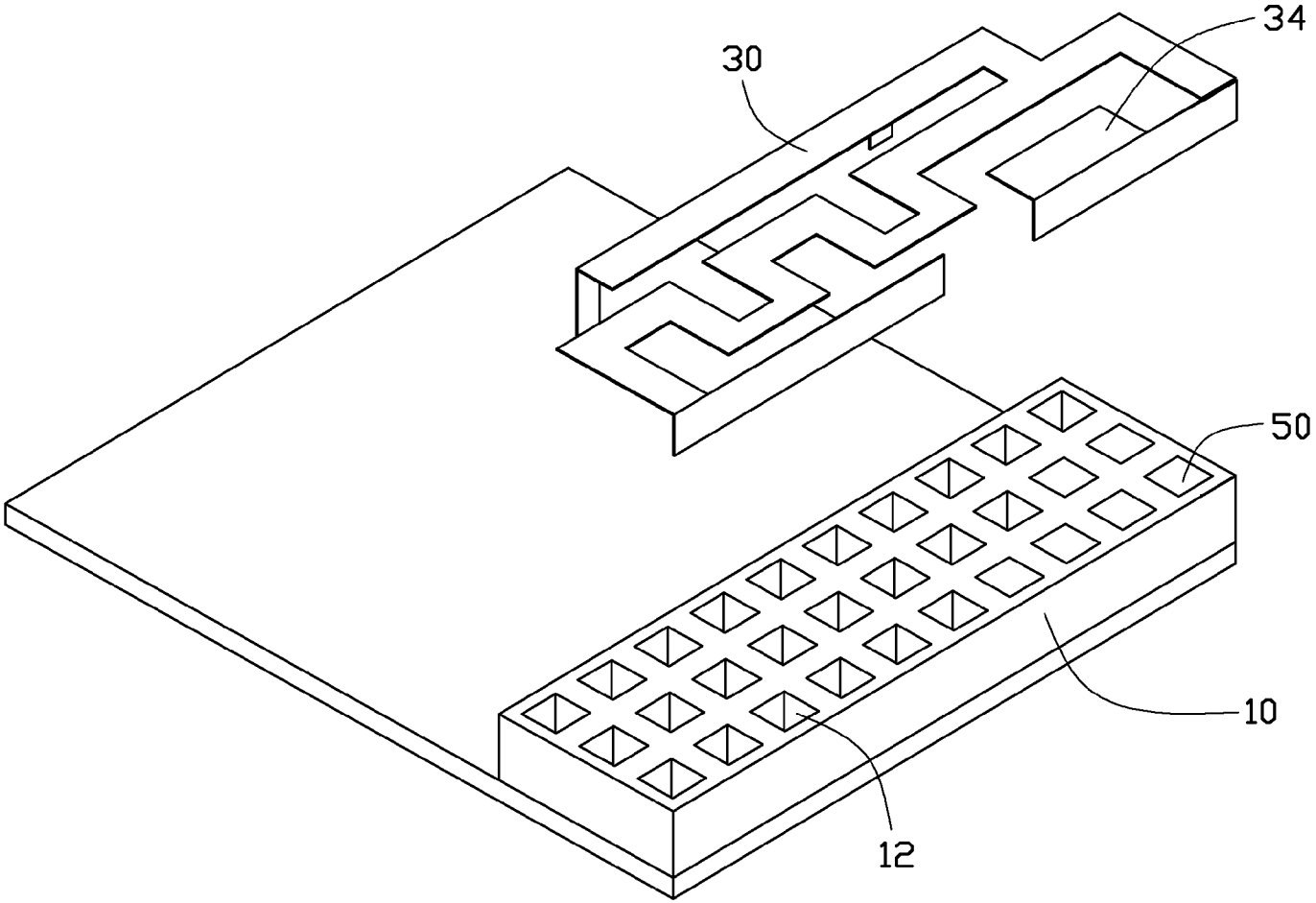
FIG. 3 shows a partially assembled view of the wireless communication device of FIG. 1, when a plurality of filling blocks are received in notches covered by a first radiating unit of the antenna module.
Figure 4:
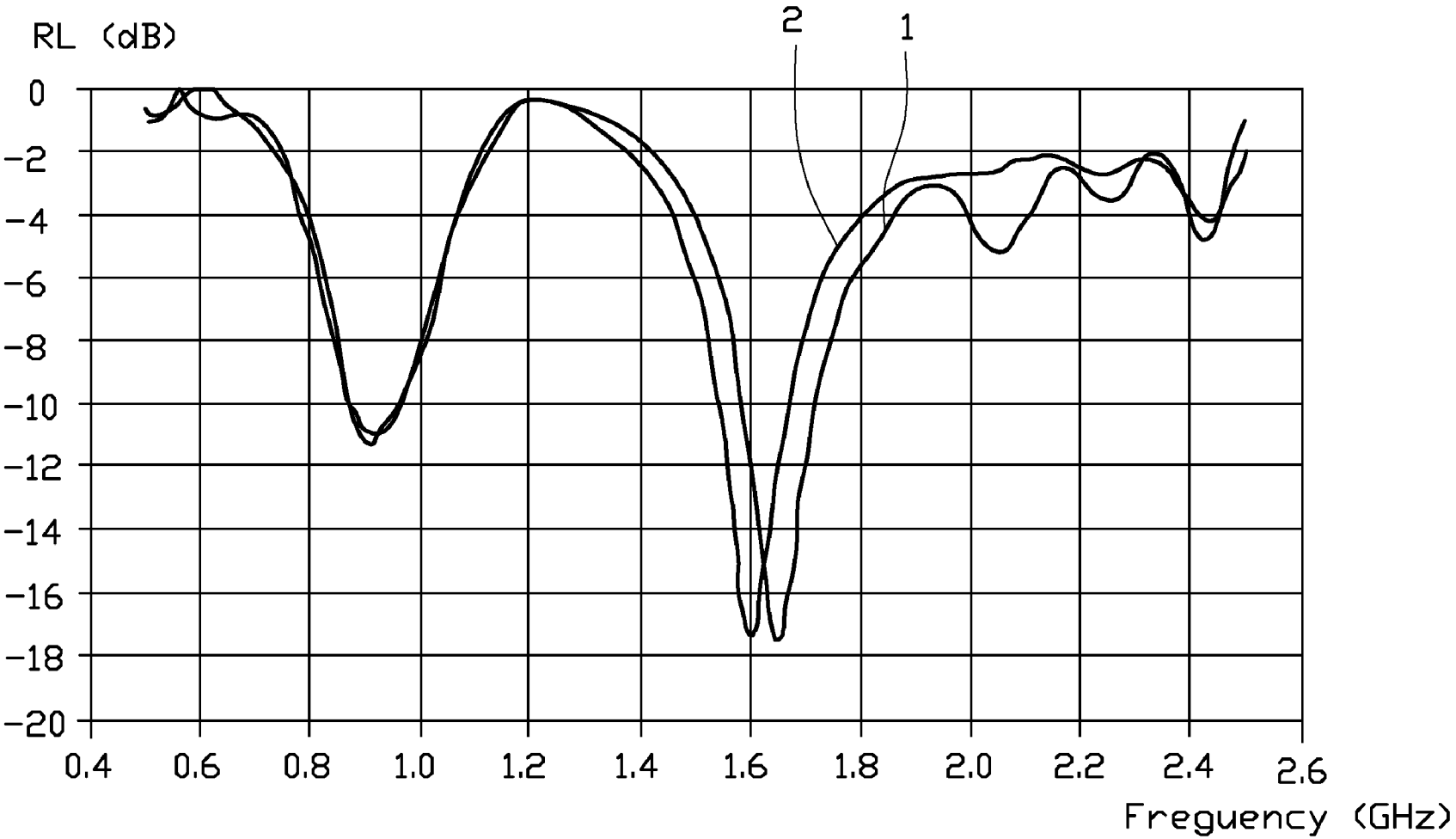
FIG. 4 shows a test graph obtained from the antenna module of FIG. 3 and an antenna module having no filling blocks received in notches, disclosing return loss varying with frequency.

Referring to FIG. 3, to adjust a frequency of the first radiating unit 32, the filling blocks 50 are received in the notches 12 covered by the first radiating unit 32. Also referring to FIG. 4, the curve 1 represents the frequency of the first radiating unit 32, when the filling blocks 15 are received in the notches 12. The curve 2 represents the frequency of the first radiating unit 32, when the antenna 30 has no filling blocks 50. The central frequency of the first radiating unit 32 can be adjusted from about 1650 MHz to about 1600 MHz by the filling blocks 50.

Figure 5:
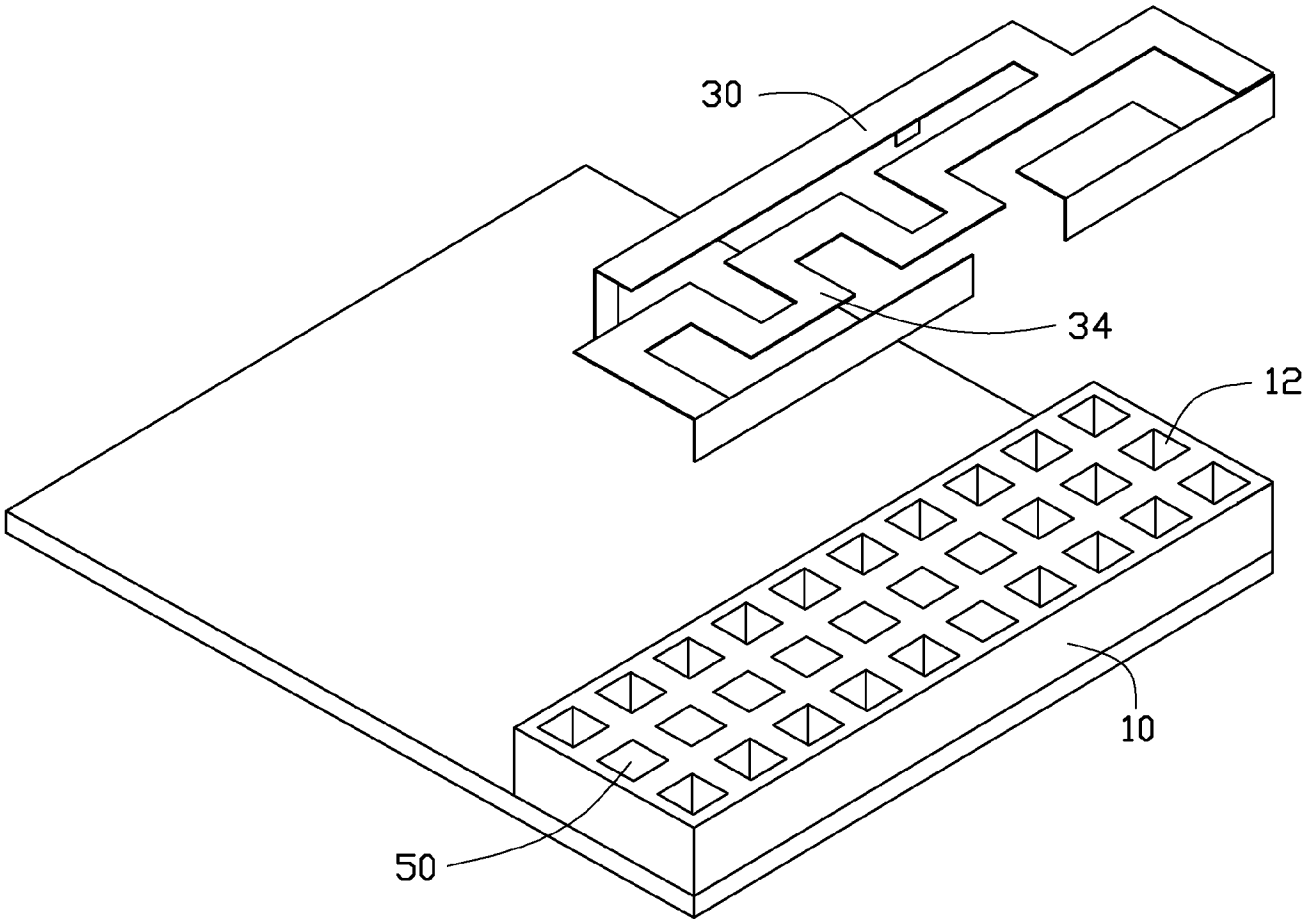
FIG. 5 shows a partially assembled view of the wireless communication device of FIG. 1, when a plurality of filling blocks are received in notches covered by a second radiating unit of the antenna module.
Figure 6:
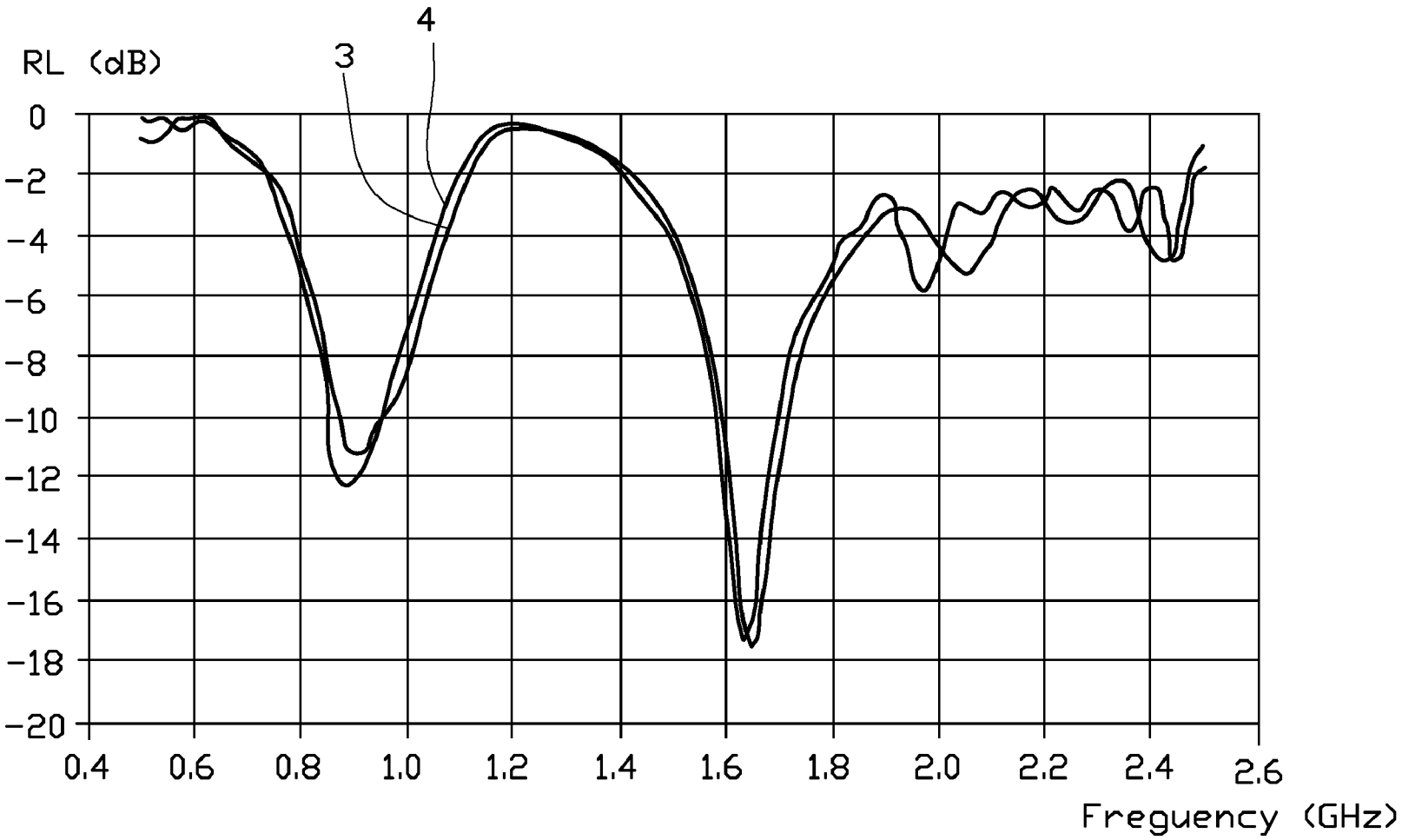
FIG. 6 shows a test graph obtained from the antenna module of FIG. 5 and an antenna module having no filling blocks received in notches, disclosing return loss varying with frequency.

Referring to FIG. 5, to adjust a frequency of the second radiating unit 34, the filling blocks 50 are received in the notches 12 covered by the second radiating unit 34. Also referring to FIG. 6, the curve 3 represents the frequency of the second radiating unit 34, when the filling blocks 50 are received in the notches 12. The curve 4 represents the frequency of the first radiating unit 34, when the antenna module 100 has no filling blocks 50. The central frequency of the first radiating unit 32 can be adjusted from about 900 MHz to about 860 MHz by the filling blocks 50.

Figure 7:
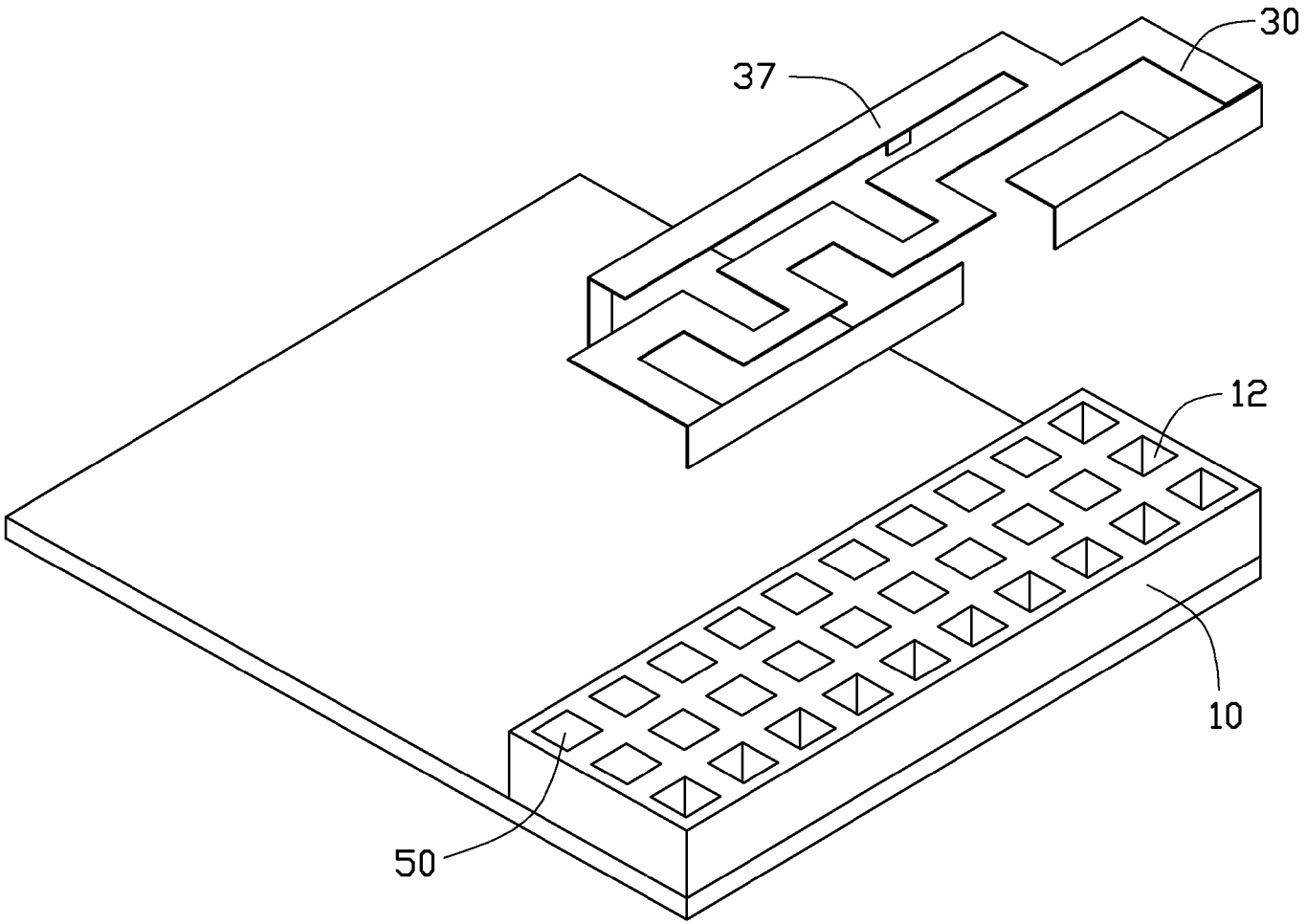
FIG. 7 shows a partially assembled view of the wireless communication device of FIG. 1, when a plurality of filling blocks are received in notches covered by and adjacent to a matching portion of the antenna module.
Figure 8:
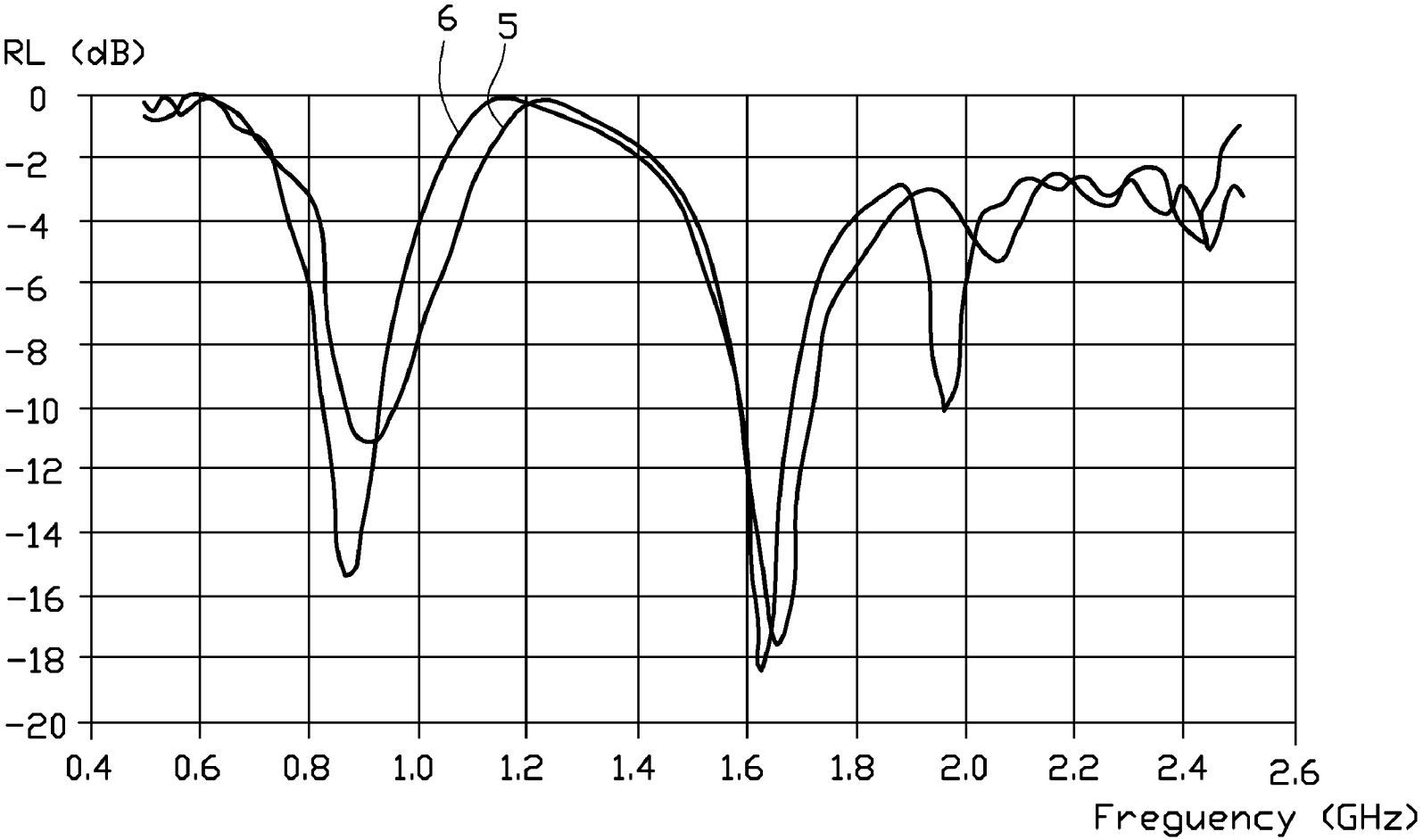
FIG. 8 shows a test graph obtained from the antenna module of FIG. 7 and an antenna module having no filling blocks received in notches, disclosing return loss varying with frequency.

Referring to FIG. 7, a matching impedance of the antenna module 100 can be adjusted by filling the filling blocks 50 in the notches 12 covered by and adjacent to the matching portion 37. Referring to FIG. 8, the curve 5 represents the frequency of antenna module 100 when the matching impedance of the antenna module 100 is adjusted; the curve 6 represents the frequency of antenna module 100 when the matching impedance of the antenna module 100 is not adjusted. The antenna module 100 obtains an improved frequency band from 800 MHz to 1000 MHz which has lower return loss values.

In other embodiments, the number of the filling blocks 50 can be changed according to different communication requirements.

The antenna module 100 adjusts the frequencies of the antenna 30 by the filling blocks 50 having a higher permittivity to avoid a matching circuit.

It is believed that the exemplary embodiments and their advantages will be understood from the foregoing description, and it will be apparent that various changes may be made thereto without departing from the spirit and scope of the disclosure or sacrificing all of its material advantages, the examples hereinbefore described merely being preferred or exemplary embodiments of the disclosure.

What is claimed is:

1. An antenna module, comprising:

a dual-band antenna comprising a first radiating unit and a second radiating unit respectively configured for receiving and/or sending high and low frequency band signals;

a substrate defining a plurality of notches; and a plurality of filling blocks having a permittivity higher than the substrate; wherein the antenna is attached to the substrate, the filling blocks are received in the notches covered by one of the first radiating unit and the second radiating unit to raise the permittivity of the substrate.

2. The antenna module as claimed in claim 1, wherein the substrate is plastic, the filling blocks are made of rubber or ceramics.

3. The antenna module as claimed in claim 1, wherein the notches arrange in a matrix array in the substrate.

4. The antenna module as claimed in claim 1, wherein the first radiating unit includes a first shielding portion, a second shielding portion and a first bent portion connecting perpendicular to the first shielding portion and second shielding portion, the first shielding portion is disposed at one side of the first shielding portion, and coplanar with and partially surrounded by the first shielding portion.

5. The antenna module as claimed in claim 4, wherein the first shielding portion is substantially an L-shaped sheet, the second shielding portion is substantially a rectangular sheet.

6. The antenna module as claimed in claim 1, wherein the second radiating unit includes a square-wave shaped third shielding portion and a second bent portion connecting perpendicular to the third shielding portion.

7. The antenna module as claimed in claim 6, further includes a feeding portion, a matching portion and a grounding portion, wherein the feeding portion extends from the first radiating unit, the matching portion connects to the feeding portion and the grounding portion.

8. The antenna module as claimed in claim 7, wherein the substrate includes a mounting surface and a side surface, the mounting surface defines the notches, the first, second, and third shielding portions, the feeding portion, and the matching portion are flatly attached to the mounting surface, the first bent portion and the second bent portion are flatly attached to the side surface.

9. A wireless communication device, comprising:

a base board including a feeding point and a grounding point;

an antenna module, comprising an dual-band antenna connecting to the feeding point and the grounding point of the base board, the antenna comprising a first radiating unit and a second radiating unit respectively configured for receiving and/or sending high and low frequency band signals, the antenna;

a substrate defining a plurality of notches and mounted in the base board; and a plurality of filling blocks having a permittivity higher than the substrate; wherein the antenna is attached to the substrate, the filling blocks are received in a the notches covered by one of the first radiating unit and the second radiating unit to raise the permittivity of the substrate.

10. The wireless communication device as claimed in claim 9, wherein the substrate is plastic, the filling blocks are made of rubber or ceramics.

11. The wireless communication device as claimed in claim 9, wherein the first radiating unit includes a first shielding portion, a second shielding portion and a first bent portion connecting perpendicular to the first shielding portion and second shielding portion, the first shielding portion is disposed at one side of the first shielding portion, and coplanar with and partially surrounded by the first shielding portion.

12. The wireless communication device as claimed in claim 11, wherein the first shielding portion is substantially an L-shaped sheet, the second shielding portion is substantially a rectangular sheet.

13. The wireless communication device as claimed in claim 11, wherein the second radiating unit includes a square-wave shaped third shielding portion and a second bent portion connecting perpendicular to the third shielding portion.

14. The wireless communication device as claimed in claim 13, wherein the antenna module further includes a feeding portion, a matching portion and a grounding portion, wherein the feeding portion extends from the first radiating unit, the matching portion connects to the feeding portion and the grounding portion.

15. An antenna module, comprising:

a dual-band antenna, the antenna comprising:

a first radiating unit configured for receiving and/or sending high frequency band signals;

a second radiating unit configured for receiving and/or sending low frequency band signals;

a feeding portion extending from the first radiating unit;

a ground portion; and a matching portion connecting to the feeding portion and the grounding portion;

a substrate defining a plurality of notches; and a plurality of filling blocks having a permittivity higher than the substrate; wherein the antenna is attached to the substrate, the filling blocks are received in the notches covered by the matching portion to raise the permittivity of the substrate.

16. The antenna module as claimed in claim 15, wherein the matching portion is a substantially strip-shaped sheet connecting substantially perpendicular to the feeding portion.

17. The antenna module as claimed in claim 16, wherein the first radiating unit includes a first shielding portion, a second shielding portion and a first bent portion connecting perpendicular to the first shielding portion and second shielding portion, the first shielding portion is disposed at one side of the first shielding portion, and coplanar with and partially surrounded by the first shielding portion.

18. The antenna module as claimed in claim 17, wherein the first shielding portion is substantially an L-shaped sheet, the second shielding portion is substantially a rectangular sheet.

19. The antenna module as claimed in claim 17, wherein the second radiating unit includes a square-wave shaped third shielding portion and a second bent portion connecting perpendicular to the third shielding portion.

* * * * *